United States Patent [19]

Hull

[11] Patent Number: 4,590,847

[45] Date of Patent: May 27, 1986

[54] SUPPLY MAKE-UP AIR ATTACHMENT FOR EXHAUST BOOTHS

[76] Inventor: Francis R. Hull, 23-03 45th Rd., Long Island City, N.Y. 11101

[21] Appl. No.: 664,204

[22] Filed: Oct. 24, 1984

Related U.S. Application Data

[63] Continuation-in-part of Ser. No. 437,499, Dec. 29, 1982, abandoned.

[51] Int. Cl.[4] ..... B08B 15/02

[52] U.S. Cl. ..... 98/115.3; 98/36; 98/40.18; 98/115.2; 239/455

[58] Field of Search ..... 55/DIG. 29; 98/36, 40.19, 98/115.1, 115.2, 115.3, 115.4, 90, 40.18; 34/222, 243 C; 234/451, 455

[56] References Cited

U.S. PATENT DOCUMENTS

| | | | |
|---|---|---|---|
| 907,609 | 12/1908 | Kirk | 98/36 |
| 1,520,267 | 12/1924 | Waltz | 98/115.2 |
| 2,132,826 | 10/1938 | Ludwig | 98/115.2 |
| 2,649,727 | 8/1953 | Snow et al. | 98/115.3 |
| 2,664,700 | 1/1954 | Benoit | 239/451 X |
| 2,754,746 | 7/1956 | O'Brien | 98/36 |
| 2,857,108 | 10/1958 | Wallace | 98/40.19 |
| 3,218,953 | 11/1965 | Grow et al. | 98/115.3 |
| 3,254,588 | 6/1966 | Truhan | 98/115.3 |
| 3,270,655 | 9/1966 | Guirl et al. | 98/36 |
| 3,496,857 | 2/1970 | Ellis et al. | 98/115.3 |
| 3,664,254 | 5/1972 | Henson | 98/36 |
| 3,747,505 | 7/1973 | Turko | 98/115.3 |
| 4,427,427 | 1/1984 | DeVecchi | 98/115.3 |

FOREIGN PATENT DOCUMENTS

| | | | |
|---|---|---|---|
| 2314072 | 10/1974 | Fed. Rep. of Germany | 34/222 |
| 567039 | 9/1957 | Italy | 98/36 |
| 2064100 | 6/1981 | United Kingdom | 98/115.3 |

*Primary Examiner*—Harold Joyce

[57] ABSTRACT

Energy conservation upgrading of existing large continuous atmospheric exhaust booths such as used for spray painting or abrasive blasting occurs when the exhaust booth is supplied with outside make-up air to substantially reduce the outflow of heated air or conditioned air from the building. Fresh outside make-up air may be discharged into the exhaust booth at its inlet opening as a transverse downdraft air curtain and left-and-right side oblique air curtains which substantially prevent the escape of air pollutants from the upper booth inlet zone. A reduced building air inflow into the lower booth inlet zone prevents the escape of air pollutants from this region. Attachable air curtain supply make-up apparatus is disclosed which can be custom fitted about the peripheral air inlet opening of existing exhaust booths. Attachable air curtain supply make-up apparatus is disclosed which can be extensibly adjusted to the inlet opening of existing exhaust booths having different dimensions, and permit the premanufacture of standardized supply make-up air apparatus.

8 Claims, 11 Drawing Figures

SUPPLY MAKE-UP AIR ATTACHMENT FOR EXHAUST BOOTHS

The present invention is a continuation-in-part of my presently pending application Ser. No. 437,499 entitled "Exhaust Booth With Supply Make-Up Air" filed Dec. 29, 1982 now abandoned.

This invention relates to the energy conservation upgrading of existing exhaust booths and newly constructed exhaust booth structures with new supply make-up conduit attachments. The improved exhaust booth systems discharge continuously to atmosphere while outside make-up air is supplied as booth inlet air curtain energy barriers which prevent the escape of pollutants and reduce the discharge of interior building air from the building spaces where the exhaust booths are housed.

An exhaust booth is an enclosure equipped with an exhaust fan within which operations such as spray painting, dipping, abrasive blasting and the like are carried out. Exhaust booths typically have an open inlet to provide for work access and admit inflowing building air. Air from the building flows into the booth inlet at sufficient velocity to prevent the escape of air pollutants (solvent fumes, particulate dusts, etc.) from the booth during coating or blasting operations. Large volumetric discharges of heated or conditioned interior air from a building housing a large continuous exhaust booth is a typical condition, and the energy losses become especially severe when factories have large multiple exhaust booth systems.

In a building which houses a single large continuous exhaust booth, the energy loss (comprised of the difference between the energy content of the building discharge and atmospheric air) can be very burdensome. One large coating company conducting multiple spray painting operations during a recent winter had a building temperature of 40° F. while their heating system operated at maximum capacity, and the outside air temperature was 9° F. The present invention develops economical new methods which substantially reduce the energy losses from a building housing a continuous exhaust booth, by providing attachable air curtain supply make-up apparatus which delivers a substantial independent supply of outside air into the exhaust booth enclosure about the periphery of its inlet opening.

While the apparatus of the invention is described in connection with existing spray painting exhaust booths with attached new supply make-up air curtain apparatus that reduce the volumetric discharge of interior building air, it will be understood by those skilled in the art that variations of the methods described hereinafter may be employed in the design of other supply make-up air apparatus for exhaust booths without departing from the scope of the invention.

The primary object of the invention is to develop supply make-up air apparatus which is attachable to the inlet periphery of large exhaust booths, and which substantially decrease building energy losses by reducing the discharge of interior air which the booth exhausts from its building.

Another important object is to develop supply air entrance configurations for exhaust booths which prevent the escape of air pollutants from the booth inlet while the inflow of interior building air is substantially reduced.

Still another object is to develop supply make-up air apparatus which can be adjustably attached to the air inlet opening of existing exhaust booths, and which is compatable with the coating or blasting work carried out therewithin.

With the foregoing objects in view, together with others which will appear as the description proceeds, the invention resides in the novel arrangement and configuration of attachable supply make-up air apparatus which will be described fully in the discussion, illustrated in the drawings, and defined in the claims.

IN THE DRAWINGS

Figure 1:
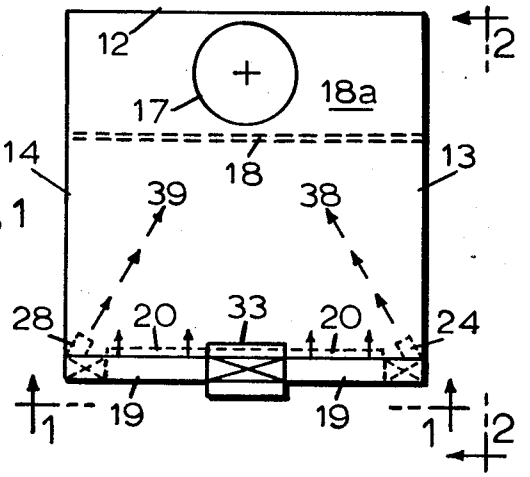
FIG. 1 is a plan view of an upgraded spray painting exhaust booth having a fixed-type supply make-up apparatus which is attached to and disposed peripherally around the frontal booth inlet.
Figure 2:
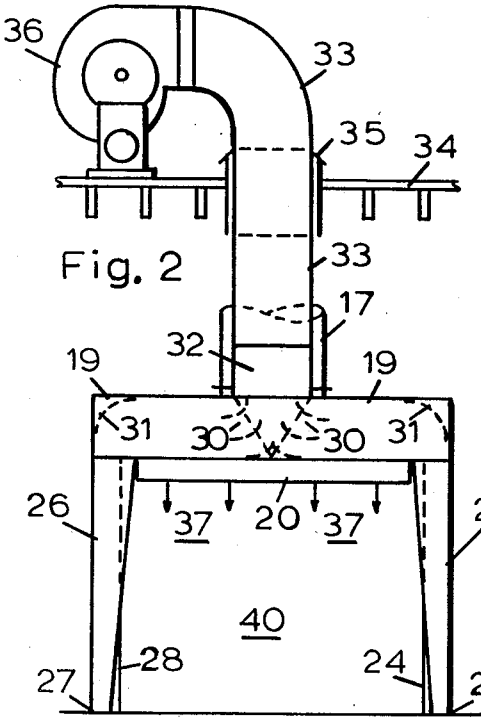
FIG. 2 is a frontal elevation of the upgraded exhaust booth installation taken along line 1—1 of FIG. 1.
Figure 3:
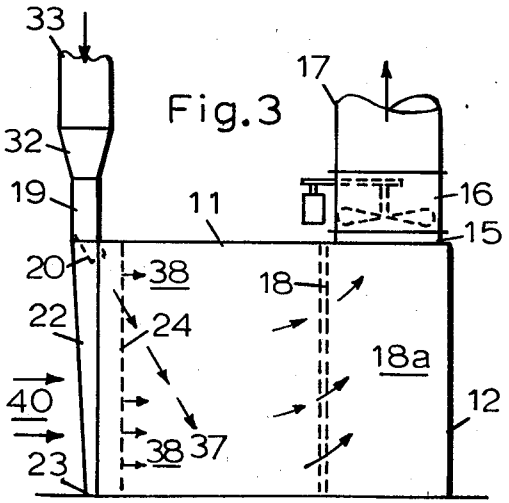
FIG. 3 is a side elevation of the upgraded exhaust booth installation taken along line 2—2 of FIG. 1.
Figure 4:
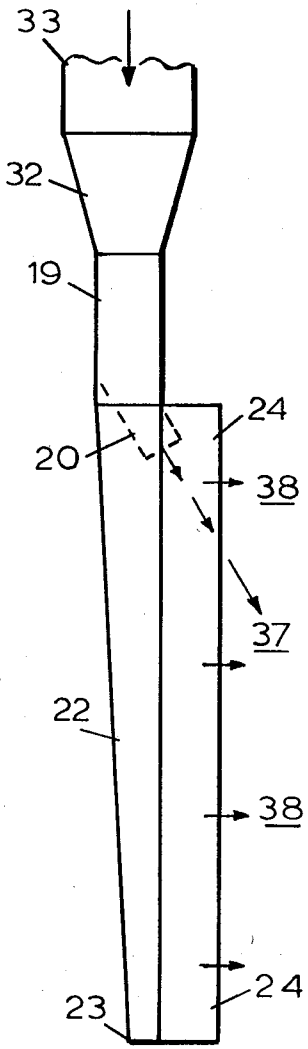
FIG. 4 is an enlarged side elevation of the supply make-up apparatus of FIG. 1 which is shown detached from the front of the exhaust booth.
Figure 5:
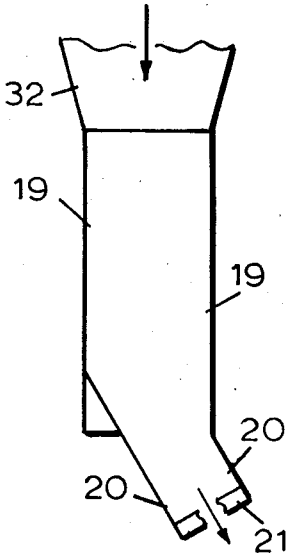
FIG. 5 is an enlarged sectional view of the top horizontal air supply header duct 19 and linear outlet nozzle 20 as disposed to develop an oblique downdraft air curtain into the exhaust booth at its frontal inlet opening.
Figure 6:
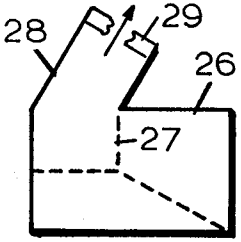
FIG. 6 is an enlarged sectional view of the left vertical air supply duct branch 26 and linear outlet nozzle 28 which develops an oblique vertical air curtain within the exhaust booth adjacent its left sidewall.
Figure 7:
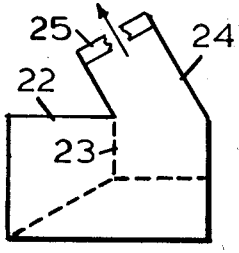
FIG. 7 is an enlarged sectional view of the right vertical air supply duct branch 22 and linear outlet nozzle 24 which develops an oblique vertical air curtain within the exhaust booth adjacent its right sidewall.

In FIGS. 1–7 inclusive, a typical spray painting exhaust booth enclosure 11–18 is shown which has been upgraded by the attachment of new fixed-type air supply make-up apparatus 19–33 to its frontal inlet opening. The typical exhaust booth enclosure 11–18 is fabricated of sheet metal or other suitable material and includes top panel 11, rear end panel 12, right-side panel 13, and left-side panel 14. Exhaust booth assemblage 11–18 inclusive has exhaust outlet 15 extending from the rear of top panel 11, axial exhaust fan 16 connected to outlet 15 and exhaust duct 17. The outlet of exhaust duct 17 commonly terminates above the building roof (not shown), where solvent fumes and particulates are discharged to atmosphere. The exhaust stream flowing through the booth normally passes through internal baffles or filters at 18, where a major fraction of its point particulates or pigments are absorbed, before entering internal suction plenum 18*a* of exhaust fan 16.

Of the air volume discharged by exhaust fan 16, the minor fraction is comprised of interior building air which enters the lower region of the open front inlet at 40. The major fraction of the air volume discharged by exhaust fan 16 is provided by exterior atmospheric supply fan 36 be way of the make-up ductwork having elements 19–33 inclusive, and is discharged into the booth at the open frontal inlet through peripheral linear nozzles 20, 24 and 28.

Atmospheric air from exterior supply fan 36 is discharged downwardly through the building roof 34 and thimble 35 by way of supply duct 33 and transition 32 into transverse duct header 19, which is disposed adjacent the front edge of top panel 11. Transverse duct header 19 has internal turning vane assembly 30 and corner guide sheets 31 disposed therewithin. Duct header 19 has an oblique linear nozzle 20 formed into its sheet metal walls at the lower end. The linear outlet nozzle 20 has suitable sheet metal ribs or spreaders 21 disposed at spaced intervals along its length. Duct header 19 also has separate supply outlets at its lower right end communicating with the inlet of tapered vertical duct branch 22, and at its lower left end communicating with the inlet of tapered vertical duct branch 26.

Tapered vertical duct branch 22 disposed adjacent the front edge of side panel 13 is suitably connected to and supplied from duct header 19 at its lower right end. Vertical duct branch 22 is tapered on two sides along its length to foot 23 to distribute the air flowing into linear outlet nozzle 24. The sheet metal walls of tapered duct branch and linear outlet nozzle 24 may be formed in sections and joined by fasteners or welding. Linear outlet nozzle 24 has suitable sheet metal ribs or spreaders 25 disposed at spaced intervals along its length.

Tapered vertical duct branch 26 disposed adjacent the front edge of side panel 14 is suitably connected to and supplied from duct header 19 at its lower left end. Vertical duct branch 26 is tapered on two sides along its length to foot 27 to distribute the air flowing into linear outlet nozzle 28. The sheet metal walls of tapered duct branch 26 and linear outlet nozzle 28 may be formed in sections and joined by fasteners or welding. Linear outlet nozzle 28 has suitable sheet metal ribs or spreaders 29 disposed at spaced intervals along its length.

During operation of the make-up air system as supplied from exterior fan 36, a horizontally declined downdraft air curtain 37 is discharged into the exhaust booth at the entrance adjacent the forward edge of top panel 11 from oblique linear nozzle 20 (supplied from duct header 19). Simultaneously with the foregoing, angularly disposed side air curtains 38 and 39 are discharged into the booth entrance along vertical planes from oblique linear nozzles 24 and 28 adjacent the forward edges of side panels 13 and 14 (also supplied from duct header 19). Spray painting work within the booth normally occurs on the inside of downdraft air curtain 37 and between side air curtains 38 and 39. Downdraft air curtain 37 from oblique linear nozzle 20 establishes an energy barrier at the booth entrance which substantially prevents the escape of air pollutants into the building from the upper region of the booth inlet. Incoming air from the building interior substantially flows into the lower region of the booth inlet at 40, and prevents the escape of air pollutants from this lower inlet region.

Variations of the supply air curtain arrangements disclosed and described in the foregoing may produce other advantageous air curtain barrier patterns without departing from the scope of the invention. For example left-and-right side linear nozzle members 24 and 28 may be oriented to discharge laterally across the booth inlet so that side air curtains 38 and 39 flow directly towards each other, while the oblique linear nozzle 20 and downdraft air curtain 37 are oriented as before. This supply air curtain barrier pattern could be particularly effective in exhaust booth installations having larger inlet aspect ratios (i.e. width to height). The capacity of axial exhaust fan 16 would normally exceed that of centrifugal supply fan 36, so that a reduced quantity of interior building air would always flow into the lower region of the booth inlet around the supply air curtain barrier.

The overall exhaust booth system disclosed in FIGS. 1–7 inclusive is based on an actual engineering design. The reduction in energy losses from the building as heating or air conditioning energy is directly proportional to the capacity ratio of supply fan 36 to exhaust fan 16, and inversely proportional to the overall efficiency of the building's heating or air conditioning system. For this engineering design, the projected energy saving was about 80% of fuel consumption in the heating mode.

FIGS. 8–11 inclusive disclose elements of an adjustable air supply make-up attachment which can be fitted to the frontal inlet of existing exhaust booths having different inlet widths and heights. These adjustable arrangements permit the standard pre-manufacture of supply make-up exhaust booth attachments within the range of design limits.

Figure 10:
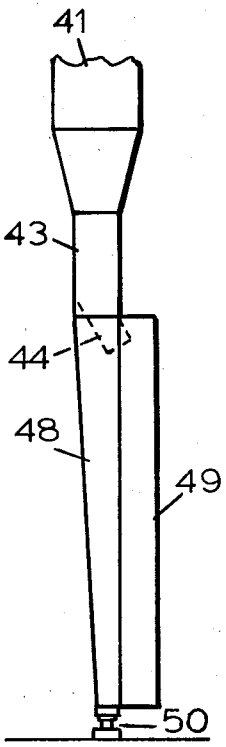
FIG. 10 is a side elevation of the adjustable air supply make-up apparatus taken along line 4—4 of FIG. 8.
Figure 8:
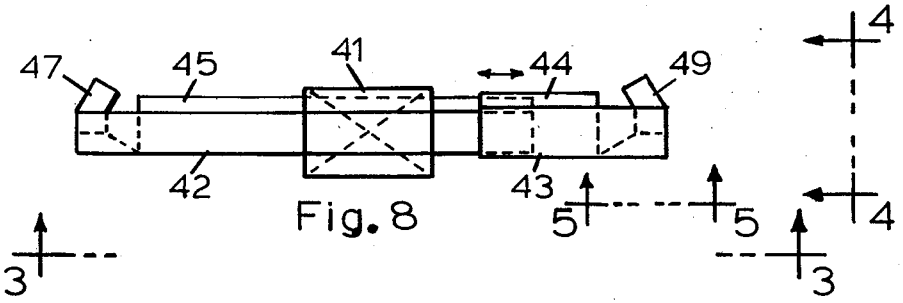
FIG. 8 is a plan view of an adjustable air supply make-up apparatus having a sliding telescopic fit between sections of the top horizontal air supply header duct and linear outlet nozzle.
Figure 9:
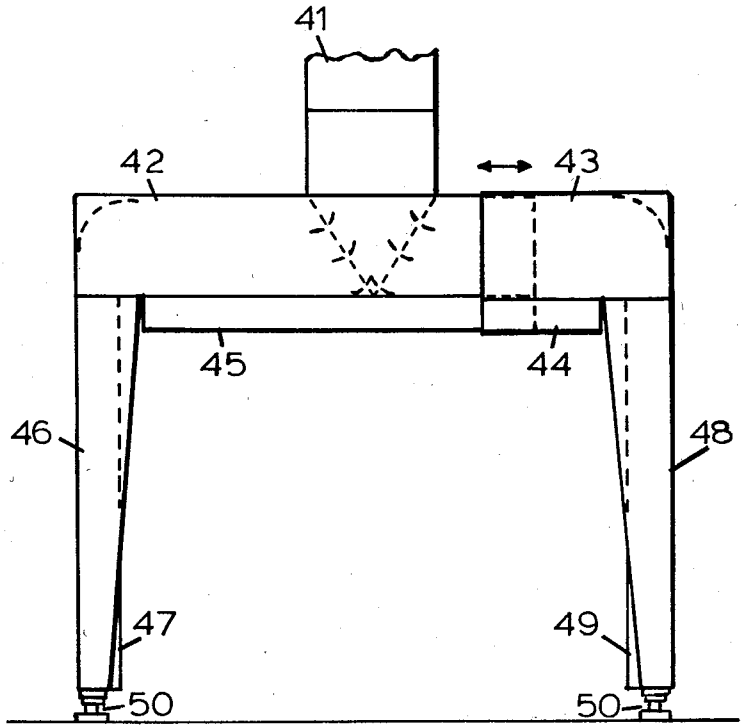
FIG. 9 is a frontal elevation of the adjustable air supply make-up apparatus taken along line 3—3 of FIG. 8.

FIGS. 8–10 illustrate plan and elevation views of the adjustable exhaust booth make-up air attachment. Outside air is supplied to the ductwork attachment from a suitable exterior fan by way of supply duct 41 and transverse horizontal duct header 42–43. Transverse horizontal duct header 42–43 has an oblique linear downdraft nozzle 45–44 formed into its lower portion, and is comprised of two sections. The left-hand duct header section 42 having oblique linear nozzle segment 45 is slidably disposed to telescope into right-hand duct header section 43 having oblique linear nozzle segment 44. Duct header section 42 has a discharge outlet at its lower left end communicating with the inlet of tapered vertical duct branch 46. Duct header section 43 has a discharge outlet at its lower right end communicating with the inlet of tapered vertical duct branch 48. Supply make-up air flowing through telescopic duct header 42–43 may be discharged simultaneously into an upgraded exhaust booth inlet through oblique linear downdraft nozzle 45–44, left oblique vertical sidedraft nozzle 47 and right oblique sidedraft nozzle 49.

Telescopic duct header 42–43 is suitably connected to and discharges into tapered duct branch 46 at its lower left end, and into tapered duct branch 48 at its lower right end. Tapered vertical duct branch 46 having oblique linear outlet nozzle 47 mounts an adjustable foot or support 50 at its closed lower end, which bears against the floor. Tapered vertical duct branch 48 mounts an adjustable foot or support 50 at its closed lower end, which bears against the floor. Similar vertical adjustments of both bearing feet or supports 50 extensibly adjust the height-of make-up air ductwork attachment 41–49 to conform to the height of a particular exhaust booth inlet opening.

Figure 11:
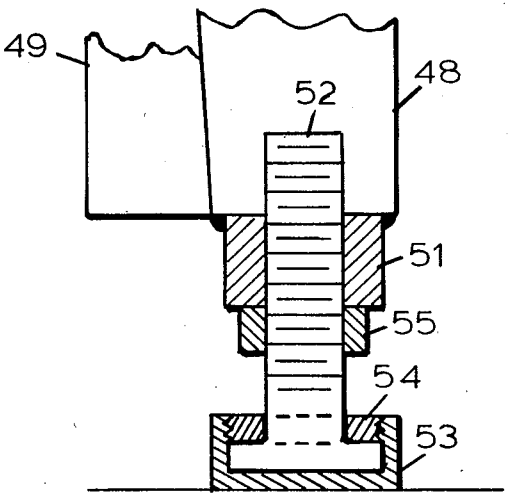
FIG. 11 is a fragmentary sectional detail of vertically adjustable supports 50 (FIG. 9), taken along line 5—5 of FIG. 8.

FIG. 11 is a fragmentary sectional assembly detail of a typical adjustable bearing foot or support 50 as it is attached to the bottom of tapered vertical duct branch 48 at the lower right-hand end of the ductwork attachment. A large threaded metal housing 51 is rigidly secured to the bottom end of duct branch 48 by welding or other suitable means. A threaded bolt 52 having a cylindrical bearing head is adjustably screwed into housing 51. The cylindrical bearing head of support bolt 52 rotatably bears against the inside cavity surface of hollowed base 53, which rests against the floor. Support bolt 52 extends through the center of washer or retainer 54, which threads into the cylindrical cavity of base fitting 53. Lock nut 55 is tightened onto housing 51 to prevent support bolt 52 from turning, after the desired height adjustment has been made.

Another variation could provide vertical height adjustments of the supply make-up air attachment for exhaust booths. In this variation, the left-and-right hand vertical duct branches at the booth inlet would be constructed of straight ductwork, and each be comprised of suctions which slidably telescope together. The left-and right hand vertical duct branches would each have several internal splitter vanes to balance air flow, and the slidable duct overlap of the telescopic sections would be disposed below the splitter vane elements.

Another variation comprised of an extendible conduit header such as 42–43 with an integral extendible linear outlet nozzle 45–44 in FIGS. 8 and 9 could be distributed as an adjustable ductwork attachment for exhaust booths having different access opening widths. In this variation, the left-hand end of conduit section 42 and the right-hand end of conduit section 43 would be closed off. The extendible air curtain ductwork attachment comprised of elements 42–45 inclusive would be adjusted to the access opening width, before attachment to the exhaust booth structure. The extendible linear outlet nozzle 45–44 would be disposed adjacent the upper edge of the access opening, so that supply air is discharged from the extendible linear outlet nozzle 45–44 as a downdraft air curtain across the access opening and into the exhaust booth. The extendible ductwork apparatus would then be supplied from an exterior fan, similarly to the arrangement shown in FIG. 2.

From the foregoing it will be perceived by those skilled in the art that the invention provides effective adjustable ductwork apparatus to be used as an attachable option for newly constructed exhaust booths or as an attachable option for the upgrading of existing continuous exhaust booths, which substantially reduce energy losses from buildings that house these exhaust enclosures.

While I have shown and described specific embodiments of the present invention, it will be understood by those skilled in the art that I do not wish to be limited exactly thereto, since various modifications of the arrangements disclosed may be made without departing from the scope of the invention as defined in the appended claims.

I claim:

1. A combination exhaust booth and adjustable air supply conduit attachment comprising: a work enclosure with a bottom working surface together with confining top and sidewalls, a frame defining an access opening through one sidewall, atmospheric exhaust conduit communicating with the interior of said work enclosure opposite said access opening, and an exhaust fan disposed in said exhaust conduit to accelerate passage of an air stream through said work enclosure from said access opening to the outlet of said atmospheric exhaust conduit; an adjustable air supply conduit attachment comprising: an extendible conduit header disposed adjacent an edge of said access opening; said extendible conduit header having a supply air inlet and an integral extendible, linear outlet nozzle along its length; said extendible conduit header being a plurality of conduit sections which slidably telescope with respect to each other; said extendible linear outlet nozzle of said extendible conduit header disposed linearly adjacent an edge of said access opening to discharge into said work enclosure; a supply conduit having an inlet exterior to said work enclosure, said supply conduit communicating with said extendible conduit header; and a supply fan disposed in said supply conduit for supplying pressurized outside air thereto; whereby exterior outside air is supplied to the said extendible conduit header and discharged from the said integral extendible, linear outlet nozzle as an air curtain energy barrier flowing across said access opening and into said work enclosure, thereby containing air pollutants within said work enclosure and reducing the quantity of interior building air which flows into said access opening of said work enclosure.

2. The combination of claim 1 wherein first and second linear outlet nozzles being connected to the opposite ends of said extendible conduit header are separately disposed linearly adjacent different edges of said access opening to discharge separate air curtain energy barriers which flow into said work enclosure.

3. A combination exhaust booth and adjustable air supply attachment comprising: an open front work enclosure with a bottom working surface together with confining top, rear and sidewalls, a frame defining a frontal access opening opposite said rear wall, atmospheric exhaust conduit communicating with the interior of said work enclosure opposite said frontal access opening, and an exhaust fan disposed in said exhaust conduit to accelerate passage of an air stream through said work enclosure from said frontal access opening to the outlet of said atmospheric exhaust conduit; an adjustable air supply conduit attachment comprising: an extendible conduit header disposed adjacent the top edge of said frontal access opening; said extendible conduit header having a supply inlet, discharge outlets at opposite ends thereof, and an integral extendible, linear outlet nozzle along its length between said discharge outlets; said extendible conduit header being a plurality of conduit sections which slidably telescope with respect to each other; said extendible linear outlet nozzle of said extendible conduit header disposed linearly adjacent the top edge of said frontal access opening to discharge downwardly into said work enclosure; first and second linear outlet nozzles connected to and supplied from said opposite discharge outlets of said extendible conduit header; said first and second linear outlet nozzles being separately disposed linearly adjacent opposite side edges of said frontal access opening to discharge into said work enclosure; a supply conduit having an inlet exterior to said work enclosure, said supply conduit communicating with said extendible conduit header; and a supply fan disposed in said supply conduit for supplying pressurized outside air thereto; whereby exterior outside air is supplied to said extendible conduit header and discharged from said integral extendible, linear outlet nozzle and from said first and second linear outlet nozzles to form separate air curtain energy barriers flowing across said frontal access opening from different directions into said work enclosure, thereby containing air pollutants within said work enclosure and reducing the quantity of interior building air which flows into said frontal access opening of said work enclosure.

4. The combination of claim 3 wherein adjustable bearing support means are connected to the lower ends of the said first and second linear outlet nozzles to vertically support said air supply conduit attachment a suitable distance from said bottom working surface; whereby the horizontal width of said air supply conduit attachment may be adjusted by slidably telescoping sections of said extendible conduit header with respect to each, while the vertical height of said air supply conduit attachment may be adjusted by the joint operation of said bearing support means, and thereby adjustably adapt said air supply conduit apparatus to attachment onto a plurality of exhaust booths having frontal access openings of different dimensions.

5. A combination exhaust booth and air supply conduit attachment comprising: an open front work enclosure with a bottom working surface together with confining top, rear and sidewalls, a frame defining a frontal access opening opposite said rear wall, atmospheric exhaust conduit communicating with the interior of said work enclosure opposite said frontal access opening, and an exhaust fan disposed in said exhaust conduit to accelerate passage of an air stream through said work enclosure from said frontal access opening to the outlet of said atmospheric exhaust conduit; an air supply conduit attachment comprising: an elongate conduit header disposed adjacent the top edge of said frontal access opening; said elongate conduit header having a supply inlet, discharge outlets at opposite ends thereof, and an integral linear outlet nozzle along its length between said discharge outlets; said integral linear outlet nozzle of said elongate conduit header disposed linearly adjacent the top edge of said frontal access opening to discharge downwardly into said work enclosure; first and second linear outlet nozzles connected to and supplied from said opposite discharge outlets of said elongate conduit header; said first and second linear outlet nozzles being separately disposed linearly adjacent opposite side edges of said frontal access opening to discharge into said work enclosure; a supply conduit having an inlet exterior to said work enclosure, said supply conduit communicating with said elongate conduit header; and a supply fan disposed in said supply conduit for supplying pressurized outside air thereto; whereby exterior outside air is supplied to said elongate conduit header and discharged from said integral linear outlet nozzle and from said first and second linear outlet nozzles to form separate air curtain energy barriers flowing across said frontal access opening from different directions into said work enclosure, thereby containing air pollutants within said work enclosure and reducing the quantity of interior building air which flows into the said frontal access opening of said work enclosure.

6. An adjustable air supply conduit accessory for disposition adjacent to the access opening of exhaust booth work enclosures comprising in combination: an extendible conduit header having a supply air inlet and an integral extendible linear outlet nozzle along its length; said extendible conduit header with integral extendible linear outlet nozzle comprised of a plurality of sections which slidably telescope with respect to each other.

7. The adjustable air supply accessory of claim 6 wherein discharge outlets are located at opposite ends of said extendible conduit header, said integral extendible linear outlet nozzle is disposed between said discharge outlets of said extendible conduit header, located at opposite ends thereof; first and second linear outlet nozzles are connected to and supplied from said opposite discharge outlets of said extendible conduit header; whereby the length of said extendible conduit header may be adjusted by slidably telescoping sections thereof with respect to each other, discharge members of the said air supply conduit accessory comprised of said integral extendible linear outlet nozzle and said first and second linear outlet nozzles may each be disposed linearly adjacent different edges of an access opening to discharge separate air curtain energy barriers which flow across said access opening from different directions, and the said air supply conduit accessory may be adjustably disposed adjacent the edges of a plurality of access openings having different dimensions.

8. The adjustable air supply conduit accessory of claim 6 wherein discharge outlets are located at opposite ends of said extendible conduit header, said integral extendible linear outlet nozzle is disposed between discharge outlets of said extendible conduit header, located at opposite ends thereof; first and second linear outlet nozzles are connected to and supplied from said opposite discharge outlets; and adjustable bearing support means are connected to the lower ends of said first and second linear outlet nozzles to vertically support said air supply conduit accessory a suitable distance from a floor or other horizontal surface; whereby the horizontal width of said air supply conduit accessory may be adjusted by slidably telescoping sections of said extendible conduit header with respect to each other, while the vertical height of said air supply conduit accessory may be adjusted by the joint operation of said bearing support means, and said air supply conduit accessory may be adjustably disposed adjacent the edges of a plurality of access openings having different dimensions.

* * * * *